United States Patent [19]

Vasudevan et al.

[11] 4,296,142

[45] Oct. 20, 1981

[54] METHOD FOR COATING A TUBULAR FOOD CASING

[75] Inventors: Ganapathy Vasudevan, Bolingbrook; Stanley Lustig, Park Forest, both of Ill.

[73] Assignee: Union Carbide Corporation, New York, N.Y.

[21] Appl. No.: 93,434

[22] Filed: Nov. 13, 1979

Related U.S. Application Data

[63] Continuation of Ser. No. 919,067, Jun. 26, 1978, abandoned.

[51] Int. Cl.[3] ..... B05D 1/06

[52] U.S. Cl. ..... 427/28; 427/32; 427/181; 427/182; 427/238

[58] Field of Search ..... 427/27, 32, 28, 180, 427/181, 182, 230, 238

[56] References Cited

U.S. PATENT DOCUMENTS

| | | | |
|---|---|---|---|
| 2,873,715 | 2/1959 | Signer | 427/230 |
| 2,961,323 | 11/1960 | Underwood et al. | 99/176 |
| 3,065,097 | 11/1962 | Zupic et al. | 427/181 |
| 3,153,599 | 10/1964 | Klein et al. | 427/180 |
| 3,436,442 | 4/1969 | Saks | 427/32 |
| 3,474,755 | 10/1969 | Voo | 427/181 |
| 3,491,721 | 1/1970 | Gill et al. | 118/622 |
| 3,693,588 | 9/1972 | Gerigk et al. | 118/407 |
| 3,886,979 | 6/1975 | Rasmussen | 138/118.1 |
| 3,905,397 | 9/1975 | Chiu | 427/230 |
| 3,923,938 | 12/1975 | Poppe | 427/32 |
| 4,207,353 | 6/1980 | Rasmussen et al. | 427/230 |

FOREIGN PATENT DOCUMENTS

| | | | |
|---|---|---|---|
| 38-18534 | of 1963 | Japan | 427/181 |
| 49-34190 | of 1974 | Japan . | |
| 51-69569 | of 1976 | Japan . | |
| 432817 | of 1967 | Switzerland | 427/32 |

*Primary Examiner*—John H. Newsome

*Attorney, Agent, or Firm*—John C. LeFever; Dale Lynn Carlson

[57] ABSTRACT

A method for coating a tubular food casing includes subjecting an inflated section of the food casing to a cloud of electrostatically charged dry particles and sintering the coated food casing. The process provides a pin-hole free coating and permits a continuous operation.

17 Claims, 3 Drawing Figures

FIG. 2
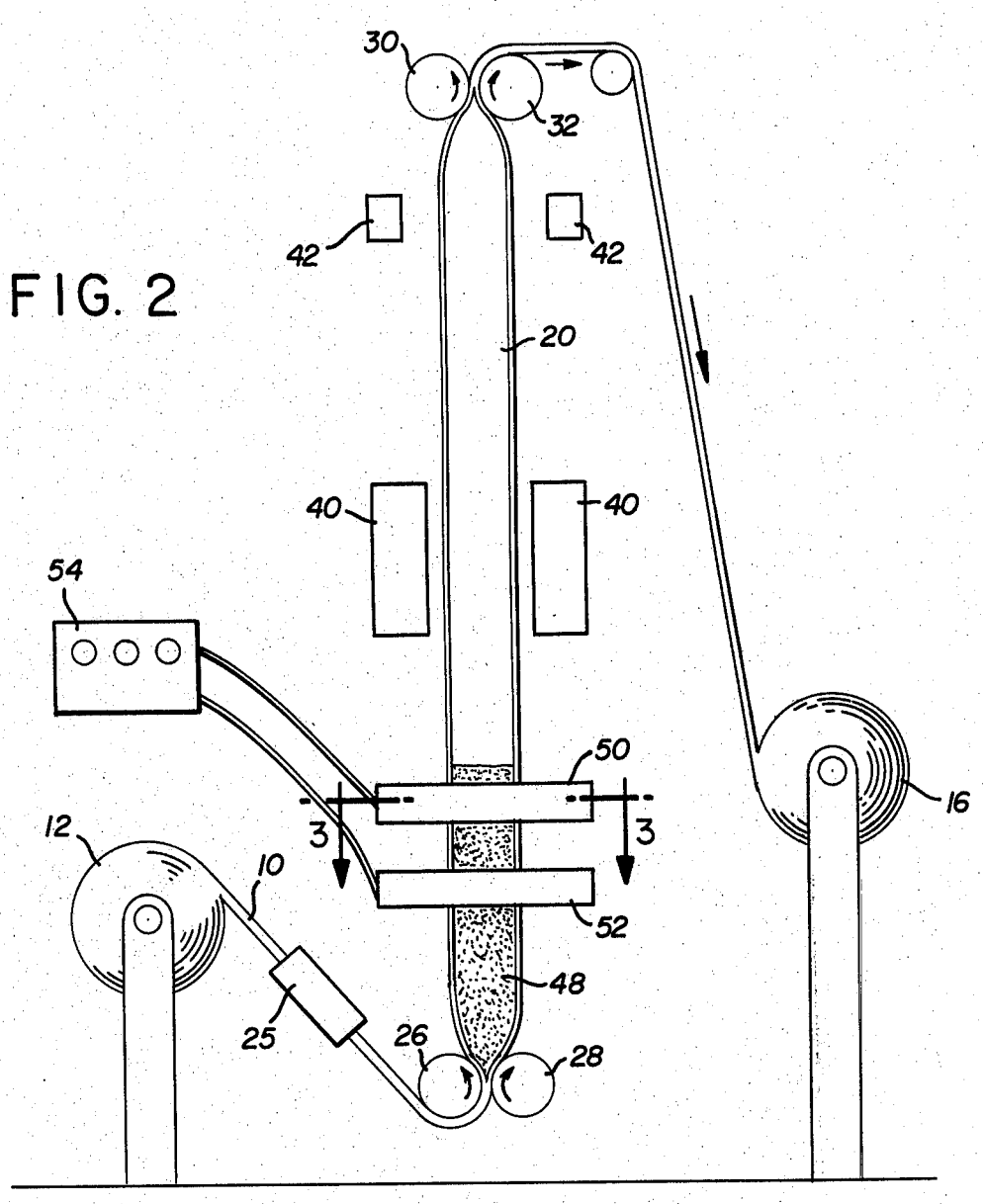
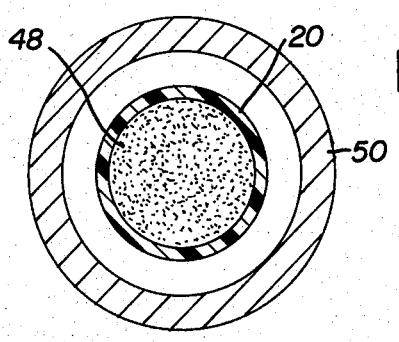
FIG. 3

METHOD FOR COATING A TUBULAR FOOD CASING

This is a continuation of application Ser. No. 919,067 filed June 26, 1978, now abandoned.

This invention relates to composite casings and more particularly to a method of forming a pin-hole free coating of resinous polymer upon a tubular cellulosic casing.

Tubular regenerated cellulose and fibrous casings are used in the food industry for processing food products such as meats, sausage, turkey, etc. A fibrous casing is composed of regenerated cellulose reinforced with a cellulosic fiber in the form of a paper preferably a long fiber hemp paper. The food product is stuffed into the casing and processed in situ. The casing serves as a container during processing of the food product and as a protective wrapping for the finished product. Since there are so many differences in recipes for making processed food products, such as sausages and so many different modes of processing the different products, it is difficult to provide a casing which is acceptable for all uses. There are also several casing applications where low moisture vapor transmission with or without low oxygen transmission are extremely important. Accordingly, it is desirable to coat fibrous and cellulose casings with a polymer resin particularly to satisfy gas and vapor permeability requirements.

Heretofore composite casings have been formed by covering a conventionally extruded tubular cellulose or fibrous casing with a coating of a preferred resin composition prepared from a solution or dispersion. The resin composition is applied by a procedure of dipping, spraying, slugging, gravure coating, or doctoring the solution or dispersion directly onto a surface of the tubular cellulose or fibrous casing.

In the conventional solution and emulsion coating processes, heat must be applied gradually to the coated casing to vaporize the solvent and at an adequate temperature to effect sintering. Rapid drying of the casing may result in entrapment of solvent or water between the casing and the coating leading to "pin-holes" and/or blisters in the coating. A "pin-hole" free coating is defined for purposes of the present invention as a continuous film essentially free from voids. The drying rate is therefore a limiting factor controlling the length of time required to sinter the coating i.e., flow and coalesce to form a continuous, tenaciously adherent coating on the casing surface. In addition, the sintering temperature cannot be too high as this could cause desiccation. Accordingly, the drying operation must be carefully controlled and monitored, since it is a principal factor in establishing the operating speed and it plays an important role in applying a uniform and continuous coating thickness.

Applicant has discovered, in accordance with the present invention, a new method of forming a relatively thick pin-hole free coating of a polymer resin upon a tubular cellulose or fibrous casing which eliminates the drying step in conventional solution and emulsion coating processes, thereby providing increased flexibility over the time of exposure to heat, operating speed and sintering temperature. In particular, the sintering time may be substantially reduced relative to the time required in conventional processes.

The present process also provides control over the uniformity in coating thickness. Thickness variations of less than about ±30% from the measured average thickness have been readily attained with the process of the present invention whereas prior art variations extend to about 80–100% from average.

The process of applicant's invention for coating the exterior surface of a casing comprises: inflating the tubular cellulose or fibrous casing; securing the inflated casing from opposite ends thereof such that the inflated casing is held in a state of tension; exposing the casing to a cloud of electrostatically charged particles of a resinuous polymer material having an average particle size less than 125 microns for a period of time sufficient to form a surface deposit of such polymer material around the casing periphery; subjecting the coated casing to a temperature sufficient to sinter said coating in a time period of less than about 5 minutes; and cooling the sintered coating.

The process of applicant's invention for coating the interior surface of an inflated tubular cellulose or fibrous casing comprises: securing the inflated casing from opposite ends thereof such that the inflated casing is held in a state of tension; introducing a slug of micronized resin powder into the interior of such inflated casing; generating an electrostatic field external of said casing and adjacent said slug of resin powder so as to form a deposit of said powder on the inside surface of the casing; advancing the casing at a predetermined rate past a sintering station; subjecting the coated casing within said sintering station to a temperature sufficient to sinter said coating about the interior of said casing; and cooling the sintered coating.

It is accordingly, the principal object of the present invention to provide a method for forming a relatively thick pin-hole free coating of a resinous material upon the surface of an extruded tubular cellulose or fibrous casing.

Additional objects and advantages of the present invention will become apparent from the following descriptions when read in conjunction with the accompanying drawings of which:

FIG. 2 is a schematic representation of the system of the present invention for coating the interior of a casing; and FIG. 3 is a cross section of the casing taken along line 3.3 of FIG. 2.

Figure 1:
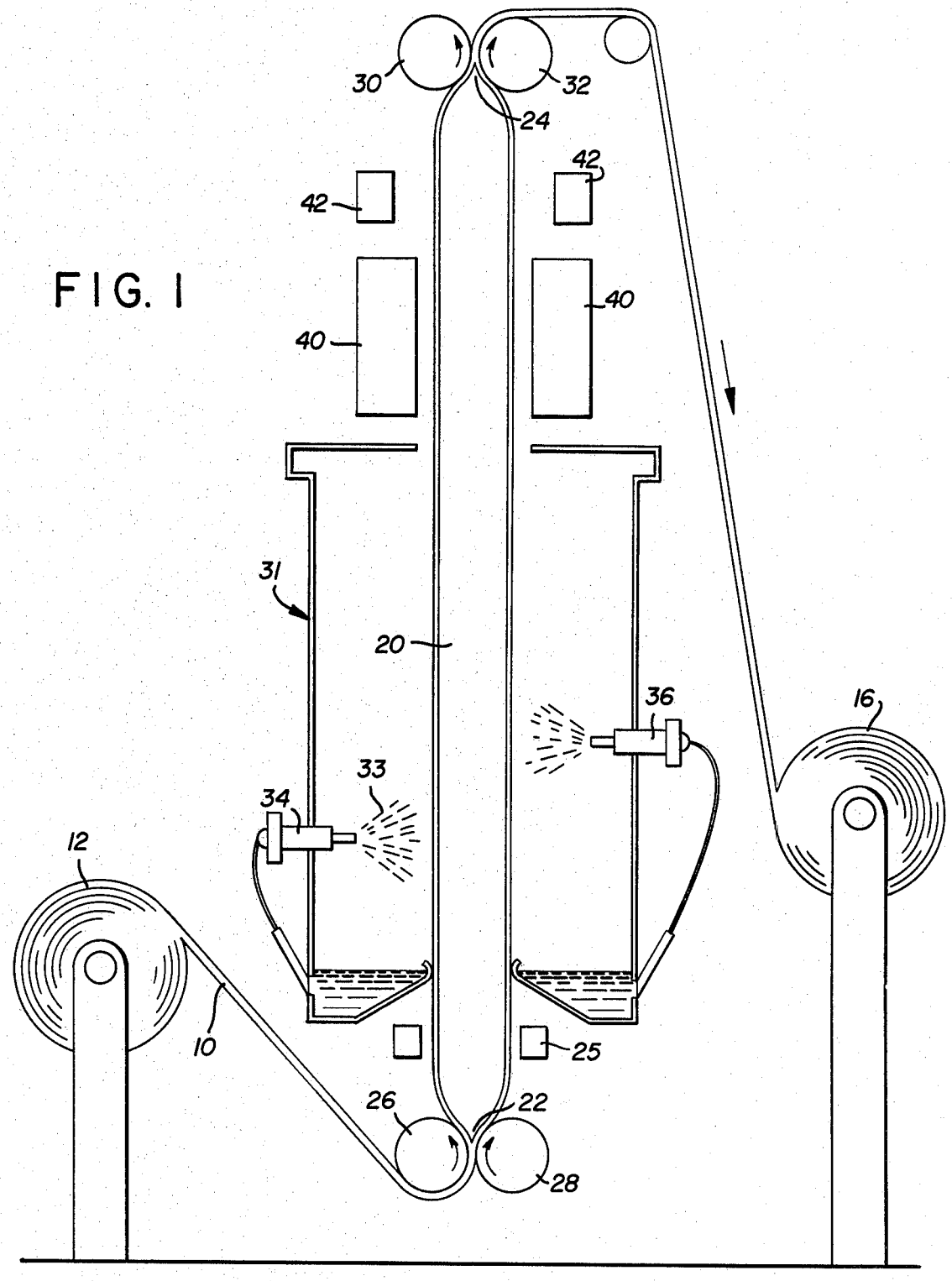
FIG. 1 is a schematic representation of an exemplary system for carrying out the method of the invention for coating the exterior surface of a casing.

The cellulose or fibrous casing 10, as identified in FIG. 1 of the drawing, is a conventional casing of tubular geometry made by any conventional extrusion process upon which a primer operating as a suitable adhesion promoter has been applied.

Primer materials which have been found compatible with the process of the present invention include the following compositions; polyhydroxylated alkoxy alkyl melamine complexes, triazine amine formaldehyde complexes, ethylene imine type compound, and the condensation product of a polyamide with epichlorohydrin or a polyamine-polyamide with epichlorohydrin or a polyamine with epichlorohydrin.

The extruded tubular casing 10, preferably with a primed surface, is thereafter flattened and wound onto a feed roll 12 whereupon, if desired, it may be stored before initiating the coating method of the present invention. Coating of the tubular casing 10 is accomplished by passing the casing 10 from the feed roll 12 through a coating and sintering operation at a controlled speed to a pich up roll 16 as hereinafter described. A section 20, representing a predetermined length of tubular casing 10 is controllably inflated to a predetermined pressure by introducing air into the casing and trapping the air between the two ends 22 and 24 of the section 20. The end 22 is squeezed between a pair of nip rolls 26 and 28 whereas the end 24 of the section 20 is squeezed between a pair of nip rolls 30 and 32 respectively.

Although the casing may be held in either a horizontal or a vertical plane during the coating operation it is preferred to have the casing aligned in a vertical plane. If the coating is applied to a casing aligned in a horizontal plane, the casing may sag since the casing can not be supported until the resinous powder is anchored permanently from the sintering process. When the casing is permitted to sag it becomes more difficult to apply a uniform coating and/or to assure uniform sintering. This problem of sagging is further aggravated at increased coating speed since the sintering time must remain constant, thereby increasing the length of unsupported casing. This length of unsupported casing is avoided or minimized by passing the casing 10 through a preheater 25 before exposing the section 20 to the electrostatic cloud 33. The preheater 25 should be located upstream of the coating chamber 31 either preceding or following the inflated end 22 of section 20 of the casing 10. Preheating the casing increases the degree of adherence between the electrostatically coated powder particle and the casing surface as will become more evident hereafter in connection with the discussion of the coating operation.

The pair of nip rolls 30 and 32 is spaced at a predetermined distance above the pair of nip rolls 26 and 28 in a common substantially vertical plane so that section 20 is held in the preferred substantially vertical position during the sequence of operations for coating and sintering the section 20. It is also preferred to maintain the section 20 under at least some tension during treatment by a differential nip roll operating speed.

The inflated and preferably preheated section 20 is advanced at the controlled speed through a coating chamber 31 in which the exposed section is subjected to a cloud 33 of electrostatically charged resinous polymeric particles for forming a coating of such particles about the periphery of the section 20. Preheating of the section 20 enhances adhesion of the coated particles by initiating sintering within the chamber 31.

The cloud 33 of electrostatically charged particles may be established by use of an electrostatic spray gun 34 as exemplified in the drawing or by means of an electrostatic fluidized bed. In each case an electrostatic field is established in which the resin particles are charged and propelled to form the electrostatic cloud. Upon dispersement, the electrostatic cloud is attracted to the tubular casing 10 which is maintained at ground potential.

In utilizing the electrostatic spray technique, it is preferred that at least two conventional electrostatic spray guns 34, 36 be employed on opposite sides of the tubular section 20 during the coating operation with one of the guns preferably elevated relative to the other. The guns are used to charge and propel the powdered resin particles which form the electrostatic cloud 33.

The particle size of the polymeric material has been found to be a critical parameter in the spray coating process. A particle size range of less than 125 microns but preferably between 20–80 microns was found necessary to form a uniform relatively thick deposit of particles.

In addition, it was found that certain electrostatic spray parameters such as spraying distance, powder flow rate and spray time must be maintained within predetermined ranges to achieve a relatively thick and evenly distributed deposit around the tubular section 20. The spraying distance or distance between the outlet nozzle of each of the spray guns 34 and 36 respectively should be maintained between about 6–9 inches from the tubular section 20. The powder flow rate should be held preferably between 2–5 grams per second from each spray gun 34 and 36 respectively. The spray time is determined by the rate of travel of the section through the electrostatic spray chamber. The rate of travel may then be varied to establish the desired thickness of deposit. When the coating thickness was under about 0.5 mils, pin-holes were observed in the finished coating.

In addition to the preferred vertical disposition of the casing 20 in the electrostatic chamber, and the selection of spray parameters and particle size range, it is necessary that the section 20 of tubular casing be inflated to a pressure which maintains the casing fully inflated, and preferably between 10–50 inches of water, during both the coating and sintering sequence. The inflation of the tubing, particularly within the preferred range, not only assists in assuring an even distribution of particles but prevents shriveling of the casing due to loss of moisture during the relatively fast sintering operation.

The preheating of the casing is also important in that sintering may actually be initiated for promoting adhesion between the electrostatic particles and the casing within the coating chamber.

Sintering of the electrostatically coated casing occurs upon passage of the casing through a stack of radiant heaters 40 for a period of less than 5 minutes and preferably less than 3 minutes at a suitable temperature of, for example, 400° F. to effect sintering. The sintering period can be reduced to under thirty seconds at a higher sintering temperature of about 510° F.

Cooling of the sintered coated section of the tubular casing is preferred before passage through the nip rolls 30 and 32. A preferred method of cooling is to use an air ring 42 for passing ambient air at a controlled flow rate about the sintered coating. The section 20 is progressively being renewed with the coated casing at the end 24 being reflattened and wound up on the take-up roll 16 while the uncoated casing upstream of end 22 is being advanced through nip rolls 26 and 28 until the entire tubing is coated with a continuous pin-hole free coating about its exterior surface.

Resinous polymers suitable for use in coating the casing of the present invention include "polyolefins", ionomers, polyamides, polyesters, polyacrylonitriles, "vinyl polymers" and epoxy resins. By polyolefins we mean polymers such as polyethylene, ethylene acrylic acid and ethylene vinyl acetate. By vinyl polymers we mean polyvinyl chloride, polyvinylidene chloride and the copolymers of vinylidene chloride. As used herein the term polymer includes homopolymers, copolymers, terpolymers, block copolymers and the like. Examples of polyvinylidene chloride copolymers include vinylidene chloride polymerized with such materials as vinyl acetate; vinyl chloride; alkyl acrylate or methacrylate such as methyl, ethyl, propyl, butyl, isobutyl; acrylonitrile; methacrylonitrile; styrene; and the like or mixture of two or more of these compounds.

The resins used as coatings may include suitable plasticizers, stabilizers, slip and antiblocking agents, pigments and other additives which are well known in the art.

The polyvinylidene chloride resin (PVDC) composition includes more than 50% vinylidene chloride and preferably between 70–95% vinylidene chloride. The following Table shows the spraying conditions for pinhole free coatings with a PVDC resin coating composition and a polyethylene coating composition.

OPERATING CONDITIONS FOR PINHOLE FREE COATING USING ELECTROSTATIC SPRAY GUN

| Sample | Resin | Particle Size | Spraying Time (sec) | Powder Output gm/sec | Spraying Distance (inch) | Average Coating Thickness (mils) |
|---|---|---|---|---|---|---|
| 1 | PVDC * | 40 microns | 3.0 | 2.0 | 10 | 1.2 |
| 2 | PVDC * | " | 3.0 | 3.0 | 8 | 2.2 |
| 3 | PVDC * | " | 2.0 | 2.3 | 8 | 1.5 |
| 4 | PVDC * | " | 2.5 | 2.2 | 9 | 1.0 |
| 5 | PVDC * | " | 6.0 | 2.0 | 8 | 3.5 |
| 6 | Polyethylene | 20 microns | 2.0 | 2.8 | 8 | 2.6 |
| 7 | Polyethylene | " | 2.5 | 3.0 | 9 | 2.2 |

* Vinylidene chloride 89–92% and Vinyl chloride 8–11%

FIG. 2 is an illustration of the preferred procedure for establishing the coating on the interior side of the inflated section 20 of casing 10. For simplicity of explanation the same reference numbers have been used to identify corresponding elements between FIG. 1 and FIG. 2.

The flat casing 10, internally coated with a primer, is held in tension between the two sets of nip rolls 26, 28 and 30 and 32 respectively in the same manner as explained heretofore with respect to FIG. 1. A slug of micronized resin powder 48 is introduced into the casing 10 within the inflated section 20. The powder coating composition is equivalent to that taught earlier for coating the exterior of the casing 10. An electrostatic field can be established by several methods using for example a high voltage AC or DC source or by means of a corona discharge. FIGS. 2 and 3 show one technique for imposing a high voltage using for purpose of illustration a pair of annular electrodes 50 and 52. The electrodes 50 and 52 surround the outer surface of the inflated section of casing 20 at a location preferably in the vicinity of the top of the column of resin powder 48 and are electrically connected to a high voltage generator 54. An electrostatic field of desired strength is generated about the column for electrostatically charging the powder 48 adjacent the electrodes 50 and 52 through induction. The powder 48 will be electrostatically attracted to the casing 20 to form a surface deposit which forms a uniform coating upon passing the coated casing through the sintering station 40 as explained heretofore in connection with FIG. 1. It may also be desirable to preheat the casing 10 using a preheater 25 to increase the degree of adherence between the electrostatically coated particles and the casing surface during the coating step.

What is claimed is:

1. A continuous process for forming a pin-hole free layer on the exterior surface of a flexible tubular cellulosic food casing, comprising the steps of:

establishing a path for processing said food casing;

providing two sets of pinch rollers at spaced apart locations along said path so that said food casing can move through said set of pinch rollers continuously while being maintained in a pinched state;

maintaining an inflated section of said food casing in tension between said sets of pinch rollers;

electrostatically coating a portion of said food casing section with dry particles of a resinous polymeric material having an average particle size of less than 125 microns to establish a coating having a thickness of at least about 0.5 mil;

moving said food casing along said path so that the coated portion of said food casing moves to a location for sintering between said sets of pinch rollers; and sintering said coated portion to form said layer.

2. A process of claim 1, further comprising the step of preheating said food casing prior to said coating step.

3. The process of claim 2, wherein said food casing is inflated to an internal pressure of between 5–50 inches of water.

4. The process of claim 3, wherein said food casing is electrostatically coated with particles having an average size range of from about 20–80 microns.

5. The process of claim 4, wherein said polymeric material is selected from the group consisting of polyolefins, ionomers, polyamides, polyesters, polyacrylonitriles, vinyl polymers and epoxy resins.

6. The process of claim 5, wherein said polymeric material is a vinyl polymer and comprises a composition containing at least 50% vinylidene chloride.

7. The process of claim 6, wherein said polymeric material is bonded to said food casing through a primer material selected from the class consisting of polyhydroxylated alkoxy alkyl melamine complexes, triazine amine formaldehyde complexes, ethylene imine type compound, and the condensation product of a polyamide with epichlorohydrin or a polyamine-polyamide with epichlorohydrin or a polyamine with epichlorohydrin.

8. The process of claim 1, wherein said sets of pinch rollers are aligned in a substantially vertical plane.

9. The process of claim 1, wherein the electrostatic coating is carried out to produce a layer thickness having a surface uniformity which varies about ±30% from its average thickness.

10. A continuous process for forming a pin-hole free layer on the interior surface of a flexible tubular cellulosic food casing, comprising the steps of:

establishing a path for processing said food casing;

providing two sets of pinch rollers at spaced apart locations along said path so that said food casing can move through said sets of pinch rollers continuously while being maintained in a pinched state;

maintaining an inflated section of said food casing in tension between said sets of pinch rollers;

providing within the interior inflated section of said food casing a predetermined amount of dry particles of a resinous polymeric material having an average particle size of less than 125 microns;

electrostatically coating a portion of the interior of said food casing section to establish a coating having a thickness of at least about 0.5 mil;

moving said food casing along said path so that the coated portion of said food casing moves to a location for sintering between said sets of pinch rollers; and sintering said coated portion to form said layer.

11. The process of claim 10, further comprising the step of preheating said food casing prior to the coating step.

12. The process of claim 11, wherein said polymeric material is selected from the group consisting of polyolefins, ionomers, polyamides, polyesters, polyacrylonitriles, vinyl polymers and epoxy resins.

13. The process of claim 12, wherein said polymeric material is a vinyl polymer and comprises a composition containing at least 50% vinylidene chloride.

14. The process of claim 10, wherein said sets of pinch rollers are aligned in a substantially vertical plane.

15. The process of claim 14, wherein said polymeric material is bonded to said casing through a primer material selected from the class consisting of: polyhydroxylated alkoxy alkyl melamine complexes, triazine amine formaldehyde complexes, ethylene imine type compound, and the condensation product of a polyamide with epichlorohydrin or a polyaminepolyamide with epichlorohydrin or a polyamine with epichlorohydrin.

16. The process of claim 1, wherein said step of electrostatically coating a portion of said food casing section with dry particles of a resinous polymeric material is conducted by electrostatically spraying said material at a powder flow rate of from 2 to 5 grams per second, with the spray being generated at a distance of from 6 to 9 inches from said portion of said food casing section being coated.

17. A continuous process for forming a pin-hole free layer on the surface of a flexible tubular cellulosic food casing, comprising the steps of:

establishing a path for processing said food casing;

providing two sets of pinch rollers at spaced apart locations along said path so that said food casing can move through said set of pinch rollers continuously while being maintained in a pinched state;

maintaining an inflated section of said food casing in tension between said sets of pinch rollers;

generating an electrostatic field and charging dry particles of a resinous polymeric material therewith to deposit said polymeric material on a portion of the surface of said flexible tubular cellulosic food casing at a thickness of at least about 0.5 mil, with said dry particles of resinous polymeric material having an average particle size of less than 125 microns;

moving said food casing along said path so that the coated portion of said food casing moves to a location for sintering between said sets of pinch rollers; and sintering said coated portion to form said layer.

* * * * *